US009039150B2

(12) United States Patent
Kagata

(10) Patent No.: US 9,039,150 B2
(45) Date of Patent: May 26, 2015

(54) LIQUID CONTAINER AND LIQUID EJECTING APPARATUS

(71) Applicant: Seiko Epson Corporation, Tokyo (JP)

(72) Inventor: Takayoshi Kagata, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/187,368

(22) Filed: Feb. 24, 2014

(65) Prior Publication Data

US 2014/0240410 A1 Aug. 28, 2014

(30) Foreign Application Priority Data

Feb. 25, 2013 (JP) ..... 2013-034391
Dec. 19, 2013 (JP) ..... 2013-262137

(51) Int. Cl.
*B41J 2/175* (2006.01)
*B41J 29/38* (2006.01)

(52) U.S. Cl.
CPC ..... *B41J 2/17503* (2013.01); *B41J 2/1752* (2013.01); *B41J 2/17546* (2013.01)

(58) Field of Classification Search
USPC ..... 347/5, 7, 19, 85; 235/375
See application file for complete search history.

(56) References Cited

U.S. PATENT DOCUMENTS

| | | | | |
|---|---|---|---|---|
| 4,353,079 | A * | 10/1982 | Kawanabe | 347/12 |
| 6,059,405 | A | 5/2000 | Mochizuki et al. | |
| 6,530,519 | B1 * | 3/2003 | Suzuki | 235/375 |
| 7,521,102 | B2 * | 4/2009 | Morizumi et al. | 428/32.52 |
| 7,543,925 | B2 | 6/2009 | Ishizawa et al. | |
| 8,398,190 | B2 | 3/2013 | Kumagai | |
| 2004/0135854 | A1 | 7/2004 | Kuwabara et al. | |

FOREIGN PATENT DOCUMENTS

| | | |
|---|---|---|
| JP | 11-048491 | 2/1999 |
| JP | 11-048492 | 2/1999 |
| JP | 11-048493 | 2/1999 |
| JP | 2012-096502 A | 5/2012 |
| JP | 2012-111060 A | 6/2012 |

* cited by examiner

*Primary Examiner* — Anh T. N. Vo
(74) *Attorney, Agent, or Firm* — Harness, Dickey & Pierce, P.L.C.

(57) ABSTRACT

A liquid container includes a liquid which generates gases over time due to a chemical change in components; a liquid storage chamber in which the liquid is stored; a liquid flow port which communicates with the liquid storage chamber, via which the liquid inside the storage chamber flows out; and an information holding portion which holds time information on manufacturing of the liquid container.

8 Claims, 7 Drawing Sheets

| ELAPSED TIME (HOUR) | AMOUNT OF GENERATED GAS (ml) | | | |
|---|---|---|---|---|
| | INK A | INK B | INK C | INK D |
| t1 | a1 | b1 | c1 | d1 |
| t2 | a2 | b2 | c2 | d2 |
| t3 | a3 | b3 | c3 | d3 |
| ⋮ | ⋮ | ⋮ | ⋮ | ⋮ |
| tn | an | bn | cn | dn |

| THRESHOLD VALUE T (HOUR) | | | |
|---|---|---|---|
| INK A | INK B | INK C | INK D |
| Ta | Tb | Tc | Td |

LIQUID CONTAINER AND LIQUID EJECTING APPARATUS

BACKGROUND

1. Technical Field

The present invention relates to a liquid container, and a liquid ejecting apparatus.

2. Related Art

An ink jet recording apparatus as an example of a liquid ejecting apparatus includes a recording head with nozzle holes, a driver which ejects ink from nozzle holes (for example, piezoelectric vibrator or heat generating element), and a controller which controls the driver according to data. When supplying ink to the nozzle holes, the supply is performed using an ink cartridge (liquid container), and an ink flow path which leads from the ink cartridge to the nozzle holes. Normally, the ink cartridge can be exchanged.

A recording quality of an ink jet recording apparatus depends on a nozzle density of a recording head which is defined by a diameter, the number, or the like, of the nozzle holes, however, the quality is also influenced by a type or viscosity of ink, a state of wet spreading of ink on a recording medium, or the like, in addition to that.

In addition, when there are bubbles (gas), or precipitate in ink, there is a case in which ejecting of ink from nozzle holes becomes unstable, and a recording quality is also influenced by such a stability of a apparatus. For this reason, there is a case in which ink is sucked from nozzle holes (referred to as cleaning), and ejecting becomes stable, for example. In particular, there is a case in which cleaning is performed until flow of ink from the ink cartridge to the nozzle holes becomes stable when a new ink cartridge is provided (exchanged). For example, in JP-A-11-048491, JP-A-11-048492, and JP-A-11-048493, an ink jet printer in which a deaeration mechanism is provided has been proposed, and discharging of gas, or the like, has been tried. In those JP-A-11-048491, JP-A-11-048492, and JP-A-11-048493, there are descriptions of separating gas which is dissolved in ink from the ink using a deaeration mechanism, and obtaining a stable ejecting performance, or the like.

However, in ink jet recording, there is a case in which bubbles are caused by some reasons, in addition to dissolved gas. For example, in a case of ink in which a material of metallic pigment is set to aluminum, and water is present in a dispersive medium, there is a case in which the aluminum produces gas by reacting to water during preservation or use, and bubbles (gas) are easily generated in the ink. In addition, in such a case, there is a case in which a degree of generation of bubbles (gas) becomes different due to an influence of a type, or an environment in preservation or usage of pigment, and it is necessary to obtain various pieces of information for a measurement thereof. In addition, when only discharging ink into which bubbles are mixed, without understanding the degree of generation of bubbles (gas), ink is wasted, or it is not possible to sufficiently remove bubbles (gas). Such a problem may also happen in a liquid other than ink.

SUMMARY

An advantage of some aspects of the present invention is to provide a recording apparatus which includes a liquid container which can stably supply liquid even when storing the liquid in which bubbles are easily generated, and can stably eject the liquid by including such a liquid container.

The invention can be realized in the following forms or application examples.

Application Example 1

According to this application example, there is provided a liquid container including a liquid which generates gases over time due to a chemical change in components; a liquid storage chamber in which the liquid is stored; a liquid flow port which communicates with the liquid storage chamber, via which the liquid inside the liquid storage chamber flows out; and an information holding portion which holds time information on manufacturing of the liquid container.

In the liquid container according to the application example, since the information holding portion which holds time information on manufacturing is included, it is possible to use the information in order to understand the amount of gas which is generated in a stored liquid. By understanding the amount of gas which is generated in the liquid, it is possible to appropriately control discharge of gas due to a liquid ejecting apparatus when the liquid container is mounted on the liquid ejecting apparatus. That is, it is possible to adjust a timing of discharging gases, a method of discharging gases, the extent of discharging gases, or the like, in the liquid ejecting apparatus. For this reason, it is possible to suppress waste of liquid, or incomplete removing of gases when removing the gas.

Application Example 2

In the liquid container according to Application Example 1, at least one of the components may be base metal pigment.

Application Example 3

In the liquid container according to Application Example 2, the base metal pigment may be coated using a protective film, and may be contained with a concentration of 5% by mass or less with respect to a total amount of the liquid.

Application Example 4

In the liquid container according to any one of Application Examples 1 to 3, the time information may include at least one piece of information among the following pieces of information of (1) to (4): (1) a date and/or a time based on an activity of manufacturing the liquid, or components thereof, (2) a date and/or a time based on an activity of storing the liquid in the liquid container, (3) a date and/or an elapsed period from a time based on the activity of manufacturing the liquid, or the components thereof, and (4) a date and/or an elapsed period from a time based on the activity of storing the liquid in the liquid container.

Application Example 5

In the liquid container according to any one of Application Examples 1 to 4, the liquid storage chamber may not be open to ambient air.

In a so-called sealed type liquid container in which a liquid storage chamber is not open to ambient air, a flow path which causes liquid to flow to the outside is only a liquid flow port. Accordingly, it is essential to discharge gases, differently from a so-called open type liquid container in which the liquid storage chamber is open to ambient air, and it is possible to discharge gases which are generated from liquid into ambient air. It is remarkably effective to appropriately adjust discharging of gases using a liquid ejecting apparatus by understanding the amount of gas which is generated in a liquid in such a sealed type liquid container in which discharging of gases is essential.

Application Example 6

In the liquid container according to any one of Application Examples 1 to 5, the liquid flow port may be provided at a position which is an upper side with respect to a center in a vertical direction of the liquid container.

Bubbles (gas) which are generated in a liquid are collected in the upper part of the liquid container by being separated from the liquid. Accordingly, when the liquid flow port is provided on the upper side of the storage body, the gas is easily discharged from a liquid outlet earlier than the liquid.

Application Example 7

According to this application example, there is provided a liquid ejecting apparatus which includes the liquid container according to any one of Application Examples 1 to 6; a cartridge holder on which the liquid container is mounted; a head which ejects liquid which is supplied from the liquid container; and a flow path which causes a liquid flow port of the liquid container and the head to communicate with each other.

In the liquid ejecting apparatus according to the application example, it is possible to understand the amount of gas which is generated in a liquid which is stored in the liquid container by obtaining time information relating to manufacturing of the liquid container from an information holding portion, and to appropriately adjust discharging of gases. That is, it is possible to adjust a timing of discharging gases, a method of discharging gases, the extent of discharging gases, or the like, in the liquid ejecting apparatus. In this manner, it is possible to suppress waste of liquid, or incomplete removing of gases when removing the gases. In addition, it is possible to stably eject liquid to a recording medium when gases in a liquid are appropriately removed.

Application Example 8

The liquid ejecting apparatus according to Application Example 7 may further include an information obtaining device which obtains the time information; a discharging device which discharges the gas; and a controller which controls the discharging device according to the time information which is obtained by the information obtaining device.

In a recording apparatus according to the application example, it is possible to discharge gases of an appropriate amount using the discharging device.

Application Example 9

In the liquid ejecting apparatus according to Application Example 8, the controller may determine whether or not it is possible to use the liquid based on the time information.

In the recording apparatus according to the application example, it is possible to prevent deteriorated liquid from being supplied to the liquid ejecting apparatus in advance. Accordingly, it is possible to suppress an unstable ejecting operation of liquid, or to suppress deterioration in a quality of an image which is formed using the liquid ejecting apparatus, or the like.

Application Example 10

In the liquid ejecting apparatus according to any one of Application Examples 7 to 9, the liquid container may be mounted on the cartridge holder by being inclined to a level surface so that the liquid flow port is located on a side which is far from the level surface.

Bubbles (gases) which are generated in a liquid are collected in the upper part of the liquid container by being separated from the liquid. Accordingly, when the liquid container is mounted on the cartridge holder in the same state as that in the application example, gases which are separated from the liquid are collected in the upper corner on the side on which the liquid flow port of the liquid container is provided, and are easily discharged from a liquid outlet earlier than the liquid.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, some embodiments of the present invention will be described. Embodiments which will be described below explain an example of the invention. The invention is not limited by any of the following embodiments, and also includes various modification examples which are executed without departing from the scope of the invention. In addition, all of configurations which are described below are not essential in the invention.

1. Liquid Container

Figure 1:
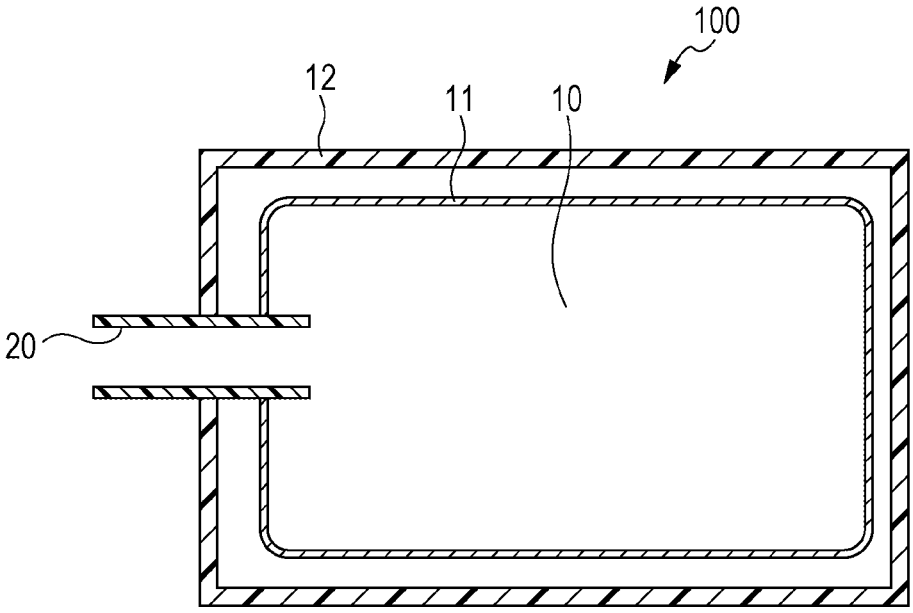
FIG. 1 is a schematic diagram of a section of a liquid container according to an embodiment.

A liquid container in the invention includes a liquid storage chamber and a liquid flow port, and is attached with a medium on which specified information is recorded. FIG. 1 is a schematic diagram of a section of a liquid container 100 according to the embodiment as a form of a liquid container according to the invention. A shape of the liquid container 100 can be made into a cartridge shape which is adapted to a apparatus when being used in an ink jet recording apparatus.

1.1. Liquid Storage Chamber

The liquid container 100 according to the embodiment includes a liquid storage chamber 10 which stores liquid.

Liquid which generates gases over time due to a chemical change in components is stored in the liquid storage chamber 10. Materials of the liquid will be described later. A structure or a material of the liquid storage chamber 10 is not particularly limited when it is possible to store and hold such liquid. The liquid storage chamber 10 can be formed using, for example, a film, a molded body, or the like. According to the embodiment, the liquid storage chamber 10 is formed of a flexible film, and the liquid storage chamber 10 is accommodated in a housing of which flexibility is relatively low. It is also possible to form the liquid storage chamber 10 itself using a relatively solid molded body, and it is possible to omit the housing 12 in this case. In the example in FIG. 1, the liquid storage chamber 10 is arranged inside the housing 12 which is formed of a resin molded body, and is formed of a bag shaped film (ink pack) 11.

The ink pack 11 which forms the liquid storage chamber 10 is configured of, for example, a high polymer, a metallic deposition film, or the like, and may be a multilayer structure. The housing 12 is a molded body of a resin, however, it is also possible to form the housing metal or paper. When the liquid container 100 is formed using a plurality of members such as the ink pack 11, the housing 12, or the like, a welded portion or a bonded portion may be formed therein. In addition, when stored liquid is influenced by a change in quality, or the like, due to a contact with ambient air, it is preferable that the ink pack 11 or the housing 12 be formed using a material of which gas transmissivity is low so as to prevent an organic solvent or water which is included in the liquid from being volatilized and evaporated. It is preferable that a material of the ink pack 11 which forms the liquid storage chamber 10 at a portion which comes into contact with stored liquid among the materials be stable with respect to the liquid.

A shape and a capacity of the liquid storage chamber 10 are not particularly limited. Liquid is stored in the liquid storage chamber 10, however, a solid body or a gas may be stored along with the liquid. A volume of liquid which is stored in the liquid storage chamber 10 is also not particularly limited.

The liquid storage chamber 10 communicates with a liquid flow port 20 which supplies liquid from the inside of the liquid storage chamber 10 to a recording apparatus.

1.2. Liquid Flow Port

The liquid container 100 according to the embodiment includes the liquid flow port 20 which communicates with the liquid storage chamber 10, and supplies liquid to the recording apparatus. The liquid flow port 20 becomes a flow path which causes liquid in the liquid storage chamber 10 to flow out to the recording apparatus.

A shape of the liquid flow port 20 is not particularly limited, and when the liquid container 100 is a cartridge of an ink jet recording apparatus, it is possible to make the shape of the liquid flow port a shape which is appropriate for being connected to a flow path for guiding ink (liquid) to a recording head of the ink jet recording apparatus. In addition, the liquid flow port 20 is connected to the ink pack 11 which forms the liquid storage chamber 10 in the illustrated example, however, a connecting method, a connecting position, or the like, thereof is also not particularly limited. However, when the liquid flow port 20 is arranged at an end in the gravity direction in a normal posture at a time of moving, transporting, and using the liquid container 100, liquid preferentially flows out from the liquid flow port 20 with ease, and in an opposite case thereof, gases preferentially flow out from the liquid flow port 20 with ease.

The liquid flow port 20 is formed using, for example, a metallic tube, a high polymer molded body, or the like. When the liquid flow port is formed using the high polymer molded body, the molded body may be integrally formed with a member which forms the ink pack 11, or may be connected thereto after being molded as a separate body, using welding, bonding, or the like. In the illustrated example, the liquid flow port 20 is formed using a resin which is cylindrically molded.

The liquid container 100 according to the embodiment is a so-called sealed type liquid container in which the liquid storage chamber 10 is not open to ambient air. As described above, in the liquid container 100 according to the embodiment of the invention, liquid which generates gases over time due to a chemical change in components is stored. In the sealed type liquid container, a flow path which causes the liquid storage chamber 10 to communicate with the outside is only the liquid flow port 20. Accordingly, the gases which are generated in the liquid storage chamber 10 flow out from the liquid flow port 20 by being mixed with liquid in a state of bubbles, and are supplied to the recording apparatus. As a result, in the recording apparatus, there is an extremely high probability that ejecting of liquid becomes unstable, or not possible. On the other hand, a so-called open type liquid container in which the liquid storage chamber is open to ambient air has been known.

Such an open type liquid container is described in Japanese Patent No. 7543925. The open type liquid container includes an air communicating port for guiding ambient air into the liquid storage chamber, and an air communicating flow path which causes the air communicating port to communicate with the liquid storage chamber. In the open type liquid container, it is possible to discharge gases to the outside through the air communicating port and the air communicating flow path even when the gases are generated in the liquid storage chamber due to a chemical change in a liquid in the liquid storage chamber. However, even in the open type liquid container, there is a possibility that the generated gases flow out from the liquid flow port 20 by being mixed with liquid in a state of bubbles while not being sufficiently separated from the liquid, and are supplied to the recording apparatus. The embodiment of the invention can also be applied to the open type liquid container, not only the sealed type liquid container.

1.3. Information Holding Portion

In the liquid container 100 according to the embodiment, a medium 30 as an information holding portion for holding time information relating to manufacturing of the liquid container 100 is provided. Time information relating to manufacturing of the liquid container 100 is recorded in the medium 30.

The medium 30 is not limited when it is a medium which can hold and transmit the time information relating to manufacturing of the liquid container 100. As the medium 30, it is possible to exemplify a label, a seal, sticky matter, a mark, a tag, a semiconductor chip, a Radio Frequency Identification (RFID), or the like. In addition, the above described information can be holded in the medium 30 as characters, a barcode, a two-dimensional code, and digital information. In addition, the medium 30 may include a function of a clock. As the medium 30 which has the function of a clock, there is a semiconductor chip, an RFID, or the like, for example.

An attaching position, or an attaching method of the medium 30 is not particularly limited as long as information which is holded in the medium 30 can be obtained by a recording apparatus 1000. According to the embodiment, the time information is recorded on the medium 30, and the information is attached to the liquid container 100, however, for example, the time information may be directly attached to the liquid container 100. As a form of directly attaching the time information to the liquid container 100, characters, marks, and the like, are carved or printed on the housing 12. In such a form, a portion of the housing 12 to which the characters, marks, and the like, are attached becomes the information holding portion. According to the embodiment, the medium 30 holds information on a type of liquid (ink) which is stored in the liquid container 100, in addition to the time information relating to manufacturing of the liquid container 100. In addition, the medium 30 may hold various pieces of information relating to the liquid container 100 such as volume of liquid (ink) which is stored in the liquid container 100, a place where the liquid container 100 is manufactured, or the like. In addition, the medium 30 may be a readable/writable medium on which new information can also be written from the recording apparatus 1000, not only the medium from which information can be read by the recording apparatus 1000.

1.4. Time Information Relating to Manufacturing of Liquid Container 100

The time information relating to manufacturing of the liquid container 100 is used when ascertaining the amount of gases which are generated in the liquid which is stored in the liquid container 100. The "time information" is at least one of a date, a time, and an elapsed period.

The time information is selected according to a property of liquid which is stored in the liquid container 100. For example, when a generation speed of a gas from the liquid is low, there is a case in which selecting of a date is sufficient even when information on a time is not selected together. In such a case, selecting of information on a time, in addition to a date is not prevented. In addition, for example, when a generation speed of a gas from the liquid is high, there also is a case in which information on a time (hour, minute, second, or the like) is selected. In addition, similarly, an elapsed period (year, month, date, hour, minute, second, or the like) from a specific time point is selected according to a property of the liquid. When information on a date, or a time is holded in the liquid container 100, a semiconductor chip in which the information is stored may be attached to the liquid container 100, or the information may be printed on the housing 12 of the liquid container 100, for example. When the information on the elapsed period is holded in the liquid container 100, a clock circuit may be provided in the liquid container 100, for example.

The "manufacturing of liquid container 100" includes filling of liquid into the ink pack, packing of the liquid container, forwarding of the liquid container, or the like, not only a completion of the liquid, the ink pack, and the liquid container, and includes a series of acts which is related to forwarding to a customer after acts for manufacturing the liquid container. As the "information on manufacturing of liquid container 100", there is manufacturing of components of liquid, manufacturing of the liquid, storing of the liquid, forwarding of a liquid container in which the liquid is filled, and packing of the liquid container in which the liquid is filled relating to the liquid which is stored in the liquid container 100, for example.

That is, when the time information is a date and/or a time, as the "time information on manufacturing of liquid container 100", there is a date and/or a time based on at least a type of act among an act of manufacturing components of the liquid, an act of manufacturing the liquid, an act of storing the liquid, an act of forwarding a liquid container in which the liquid is filled, and an act of packing the liquid container in which the liquid is filled. In addition, when the time information is the elapsed period, there is an elapsed period from a date and/or a time based on at least a type of the act among the act of manufacturing components of the liquid, the act of manufacturing the liquid, the act of storing the liquid, the act of forwarding the liquid container in which the liquid is filled, and the act of packing the liquid container in which the liquid is filled. It is preferable that at least one piece of information be adopted among pieces of information of (1) the date and/or the time based on the act of manufacturing the liquid or the components thereof, (2) the date and/or the time based on the act of storing the liquid in the liquid container 100, (3) the elapsed period from the date and/or the time based on the act of manufacturing the liquid or the components thereof, and (4) the elapsed period from the date and/or the time based on the act of storing the liquid in the liquid container 100. In addition, "based on" denotes a time which is set relating to the act, and does not denote an instant in which the act is performed.

1.5. Other Configurations

The liquid container 100 according to the embodiment may have other configurations according to a use in addition to the above described configuration. As such a configuration, for example, there is a flow path or an open valve for discharging gases which are generated from liquid, a structure body such as a pillar for preventing deformation of the liquid container 100, a mechanism for performing agitating of liquid (for example, metal ball which is arranged in liquid storage chamber 10), a joint which is provided in the liquid flow port 20, or the like.

1.6. Liquid

A liquid which is stored in the liquid container 100 according to the embodiment is not particularly limited when the liquid generates gases over time due to a chemical change in components. Here, the chemical change in the components denotes at least one of a change of one component into another material (including gas) by being denatured (decomposing, change in structure, or the like), and a change of two or more types of components to one or a plurality of materials (including gases) which are different from the original component by reacting with each other. It is preferable that the liquid which is stored in the liquid container 100 according to the embodiment be a liquid in which two or more types of components are changed to one or a plurality of materials (including gases) which are different from the original component by reacting with each other.

In addition, generating of gases over time means that there is a period in which gases are generated over time. Accordingly, the liquid which is stored in the liquid container 100 is a liquid in which there is a time (period) of generating gases due to a chemical change in components, and a liquid in a state in which components are not chemically changed yet, or a liquid in a state in which components are already chemically changed is also included.

As such a liquid, for example, there is a liquid including a material in which a chemical change may occur due to heat, light, or the like, and a combination of materials which may react with each other by coexisting, or the like, as components. In addition, when the liquid container 100 is an ink cartridge for performing ink jet recording, and ink is stored as a liquid, as the liquid (ink), for example, there are ink including metallic pigment, and ink including dye. In particular, as ink in which gases are easily generated over time, there are ink including metallic pigment and water, and ink in which the metallic pigment is formed using a material including a base metal. Here, the base metal is a metal which is also referred to as a base metal, and a metal of which an ionization tendency is larger than that of hydrogen. As a typical example of the base metal, there is an alkali metal, an alkaline earth metal, aluminum, zinc, or the like. The metallic pigment may be an alloy including at least one of these base metals. These materials react with water or an organic solvent which is included in ink, and have a tendency to generate a lot of gases.

Hereinafter, as a metal pigment, an ink composition including an aluminum pigment of which a material is aluminum which is a base metal, and water will be described as a form of liquid according to the embodiment.

Aluminum Pigment

As an aluminum pigment, for example, there is a pigment of a flat plate shape. As the flat plate shape, there is a scaly shape, a leaf shape, a plate shape, a film shape, or the like, for example. The aluminum pigment may be coated using an inorganic oxide, or the like. There is a case in which a generation of gas in ink can be suppressed by being coated. When the aluminum pigment has a flat plate shape, it is possible to easily obtain good metallic glossiness when ink is attached to a recording medium.

A mean particle diameter R50 (hereinafter, simply referred to as "R50") of 50% of equivalent circle diameter of an aluminum pigment which is coated using a coating film obtained from areas of projection images of particles obtained using a particle image analyzer is equal to or greater than 0.5 μm and equal to or smaller than 2 μm, and is preferably equal to or greater than 0.7 μm and equal to or smaller than 1.8 μm.

For the areas of the projection images of the aluminum pigment particles, and the particle image analyzer for measuring the equivalent circle diameter, there are flow type particle image analyzers FPIA-2100, FPIA-3000, FPIA-3000S, and the like (the above are made by Sysmex Corporation). In addition, here, the mean particle diameter of the equivalent circle diameter is a particle diameter based on the number. In addition, as an example of a measuring method using the FPIA-3000 and FPIA-3000S, there is a method of measuring in an HPF measuring mode using a high magnification imaging unit.

According to the embodiment, it is preferable that the maximum equivalent circle diameter of the aluminum pigment particles be equal to or smaller than 3 μm. When the equivalent circle diameter of the maximum particle is equal to or smaller than 3 μm, it is possible to suppress clogging in a nozzle opening, or an ink flow path when being used in the ink jet recording apparatus.

In addition, the thickness of the aluminum pigment particles is equal to or greater than 5 nm and equal to or smaller than 100 nm, is equal to or greater than 5 nm and equal to or smaller than 70 nm preferably, and is equal to or greater than 10 nm and equal to or smaller than 50 nm more preferably.

In addition, the thickness is measured using a transmission electron microscope, or a scanning electron microscope, for example, there are transmission electron microscopes (TEM: JEOL, JEM-2000EX), field emission type scanning electron microscopes (FE-SEM: Hitachi, S-4700), and the like. In addition, the thickness means the average thickness, and the mean value is set by performing the measurement ten times.

As a material of a coating film when the aluminum pigment has the coating film, for example, materials including alkoxysilane (for example, tetraethoxysilane (TEOS)), polysilazane, or a compound which is derived from a mixture of these, and a fluorine based material are preferably used.

In addition, the aluminum pigment may be supplied in state of being dispersed in a liquid. As components which are included in the dispersing liquid of the aluminum pigment, there are water, an organic solvent, a basic catalyst, a surfactant, a tertiary amine, a buffer solution, and the like, and these can be appropriately mixed in.

Water

For water, it is preferable to use pure water, or ultrapure water such as deionized water, ultrafiltration water, Milli Q water, and distilled water. In particular, water which is obtained by performing sterilization with respect to the above mentioned water by performing ultraviolet irradiation, or by adding hydrogen peroxide is preferably used since it is possible to suppress generating of mold or bacteria for a long time.

Others

The ink composition as an example of a liquid may include other components than that. As other components, for example, there are an organic solvent, a basic catalyst, a surfactant, a buffer solution, an alkanediol, pyrrolidones, pH control chemicals, a fixing agent such as water soluble rosin, an anti-mold agent and preservatives such as sodium benzoate, an antioxidant and an ultraviolet ray absorbent such as allophanates, an additive such as a chelating agent, an oxygen absorber, and the like.

Ink Composition

A concentration of the aluminum pigment in the ink composition is 0.1 mass % to 5.0 mass % preferably, is 0.1 mass % to 3.0 mass % more preferably, is 0.25 mass % to 2.5 mass % further more preferably, and is 0.5 mass % to 2.0 mass % especially preferably, as a solid content concentration with respect to a total mass of the ink composition. A viscosity at a temperature of 20° C. of the ink composition is equal to or greater than 2 mPa·s and equal to or less than 10 mPa·s, preferably, and is equal to or greater than 3 mPa·s and equal to or less than 5 mPa·s, more preferably.

The ink composition is obtained by mixing in each component in arbitrary order, and eliminating impurities using filtering, or the like, as necessary. As a method of mixing in each component, a method in which materials are sequentially added into a container including an agitator such as a mechanical stirrer, and a magnetic stirrer, and the materials are mixed in by being agitated is preferably used. As a method of filtering, it is possible to perform centrifugal filtering, filer filtering, or the like, as necessary.

The ink composition which is exemplified as described above can be made as a liquid which is stored in the liquid container 100 according to the embodiment. Since the above described ink composition contains the aluminum pigment and water, gases are generated over time. In addition, a point in time when manufacturing the aluminum pigment (component of liquid) means a point in time when the aluminum pigment, or the coated aluminum pigment is in a state of coming into contact with water, and a point in time when manufacturing the ink composition (liquid) means a point in time when a series of processes such as the above described mixing and filtering is ended. In addition, a point in time when the liquid is stored in the liquid container means a point in time when the liquid is guided to the liquid container, and is sealed if it is necessary to be sealed, and a point in time when the liquid is guided if it is not necessary to be sealed.

1.7. Operational Effect of Liquid Container 100

In the liquid container 100 according to the embodiment, since time information on the manufacturing of the liquid container 100 is recorded in the medium 30, the information can be used so as to ascertain the amount of gases which are generated in the liquid which is stored in the liquid container 100. By ascertaining the amount of gases which are generated in the liquid, it is possible to appropriately control discharging of the gas using the recording apparatus. That is, in the recording apparatus, a timing of discharging the gas, a method of discharging the gas, the extent of discharging the gas, or the like, can be adjusted. For this reason, it is possible to suppress waste of liquid, or incomplete removing of the gas when removing the gas. Hereinafter, a structure of the recording apparatus, and a specific example of a device for discharging the gas, or a method in the recording apparatus will be described.

2. Recording Apparatus

2.1. Entire Configuration

Figure 2:
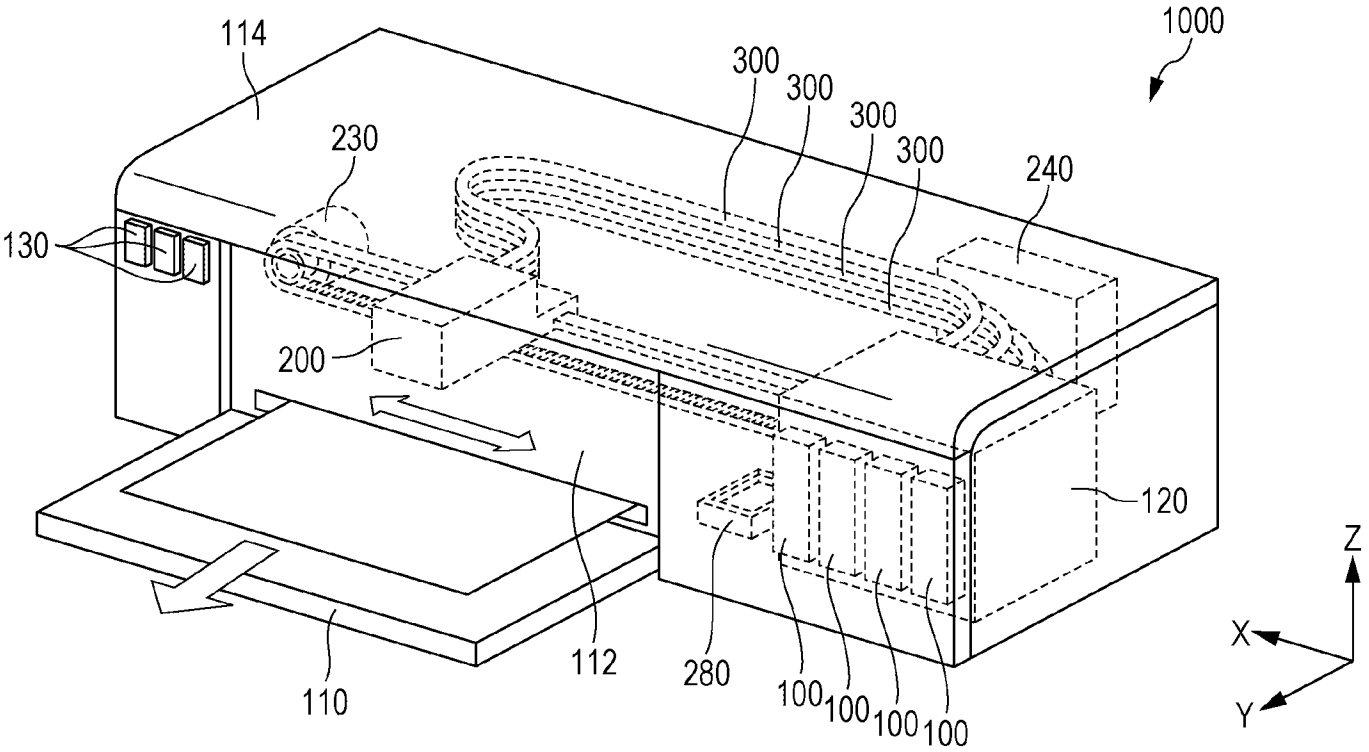
FIG. 2 is a perspective view which schematically illustrates a recording apparatus according to the embodiment.

In the embodiment, an ink jet recording apparatus as an example of the recording apparatus will be described. A recording apparatus 1000 as a form of the recording apparatus according to the embodiment of the invention includes the above described liquid container 100, a recording head 200 which attaches liquid stored in the liquid container 100 to a recording medium, and a flow path 300 for causing the liquid flow port 20 of the liquid container 100 and the recording head 200 to communicate with each other. FIG. 2 is a perspective view which schematically illustrates the recording apparatus 1000.

The recording apparatus 1000 according to the embodiment includes the recording head 200 which ejects ink as an example of the above described liquid, and can record information with respect to each recording medium by attaching ink thereto. The recording medium is not particularly limited, and for example, there are paper, a film, cloth, print paper, metal, glass, a high polymer, and the like. In addition, the medium may be any one medium of colorless and transparent, opaque, colored and transparent, an opaque chromatic color, and an opaque neutral color.

FIG. 2 illustrates a state in which four cartridges are mounted. At least one of the four cartridges can be the above described liquid container 100. FIG. 2 illustrates an example in which all of the cartridges are the liquid storage bodies 100.

Figure 3A:
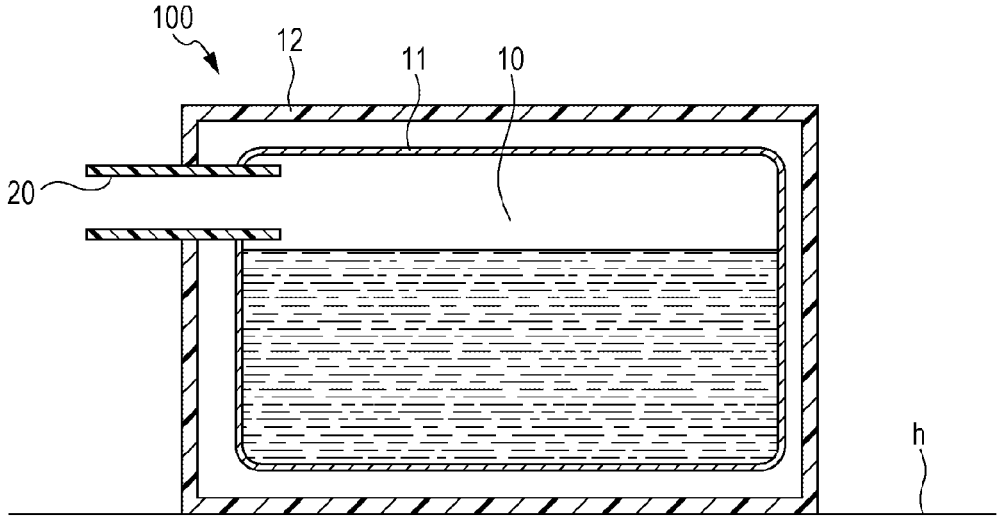
FIG. 3A is a schematic diagram which illustrates a modification example of the liquid container.
Figure 3B:
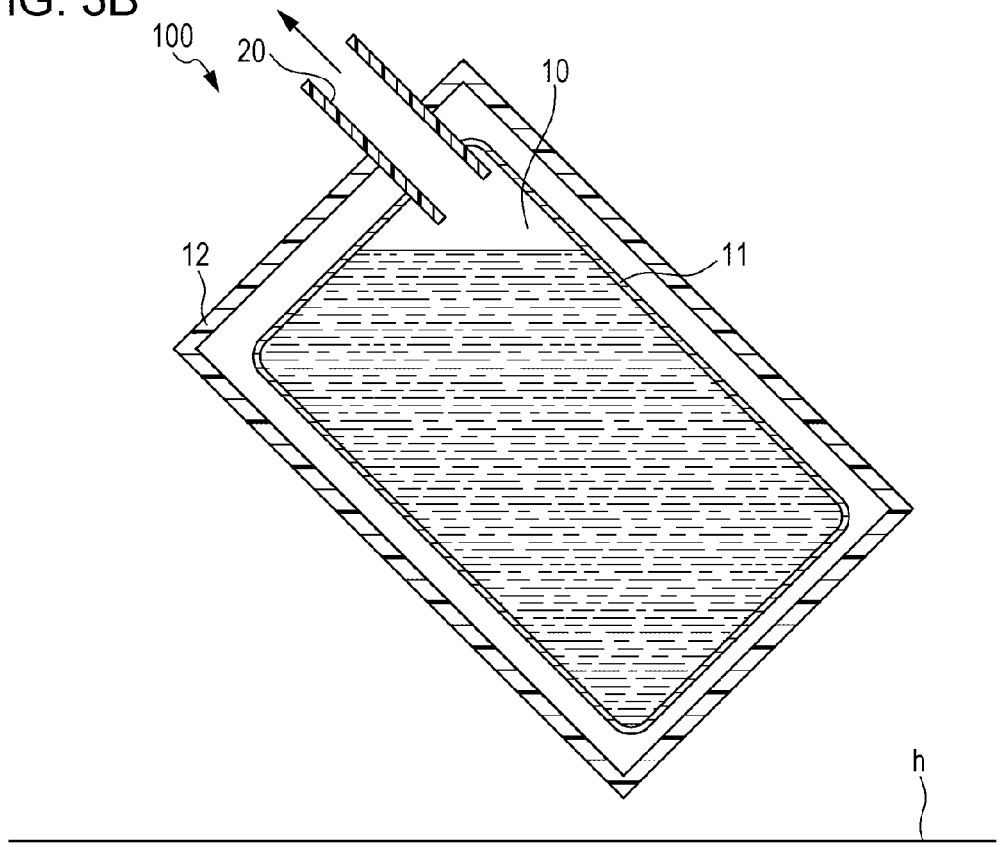
FIG. 3B is a schematic diagram which illustrates an example of an installation posture of the liquid container according to the modification example.

It is preferable that the liquid flow port 20 be provided at a position in which gases in the liquid storage chamber 10 are discharged from the liquid flow port 20 earlier than liquid (ink). In addition, it is preferable that the liquid container 100 be mounted on the recording apparatus 1000 in a posture in which the gases in the liquid storage chamber 10 are discharged from the liquid flow port 20 earlier than the liquid. As illustrated in FIG. 3A, when the liquid container 100 is put on the horizontal plane h as is, the liquid flow port 20 is provided so as to be located at the upper side with respect to a center in the vertical direction of the liquid container 100, that is, at the side which is far from the horizontal plane h. In addition, as illustrated in FIG. 3B, the liquid container 100 is mounted on a cartridge holder (not shown in FIG. 3B) in a posture of being inclined to the horizontal plane h so that the liquid flow port 20 is located on the side farther from the horizontal plane h than the state which is illustrated in FIG. 3A. That is, in the examples which are illustrated in FIGS. 3A and 3B, a position at which the liquid flow port 20 is formed, and a posture of mounting the liquid container 100 have been devised so that the liquid flow port 20 of the liquid container 100 is located on the side which is opposite to the gravity direction (vertical upper side). By doing so, as illustrated in FIG. 3B, bubbles (gases) which are generated in a liquid are easily collected in the upper part of the liquid storage chamber 10 by being separated from the liquid (ink). In addition, as illustrated in FIG. 3B using an arrow, the gases which are collected in this manner are easily discharged from the liquid flow port 20 earlier than the liquid. Accordingly, it is possible to effectively discharge the gas.

In FIG. 2, X, Y, and Z axes which are orthogonal to each other are illustrated. According to the embodiment, in a use posture of the recording apparatus 1000, the Z axis is the vertical direction (gravity direction), the Y axis is the attaching/detaching direction of the liquid container 100 with respect to a cartridge holder 120, and the X axis is the direction in which the plurality of liquid storage bodies 100 are aligned. More specifically, the positive Z axis direction is the vertical upward direction, the negative Z axis direction is the vertical downward direction, the positive Y axis direction is the direction of pulling out the liquid container 100, and the negative Y axis direction is the direction of inserting the liquid container 100. In addition, the XY plane is a plane which is parallel to the horizontal plane h.

The recording apparatus 1000 can also be referred to as a liquid consuming apparatus. A front cover 110 is provided at approximately a center of the front face of the recording apparatus 1000, and a plurality of operation buttons 130 are provided on the positive X axis direction side thereof. The front cover 110 is pivotally supported on the lower end side, and when the upper end side is tilted frontward, a sheet discharging port 112 from which a printing sheet is discharged appears. In addition, a not shown sheet feeding tray is provided on the rear surface side of the recording apparatus 1000. When an operation button 130 is operated by setting a printing sheet in the sheet feeding tray, the printing sheet is fed from the sheet feeding tray, and an image, or the like, is printed on the surface in the inside, and then the printing sheet is discharged from the sheet discharging port 112.

An upper face cover 114 is provided on the upper face side of the recording apparatus 1000. The upper face cover 114 is pivotally supported on the depth side, and when the upper face cover 114 is open by holding up the front side, it is possible to confirm a state in the recording apparatus 1000, or to perform repairing, or the like, of the recording apparatus 1000.

The recording head 200 which forms ink dots on a printing sheet by ejecting ink while reciprocating in the main scanning direction, or a driving mechanism 230 which causes the recording head 200 to reciprocate is mounted in the recording apparatus 1000. A plurality of nozzles are provided on the base side (side facing printing sheet) of the recording head 200, and ink is ejected toward the printing sheet from the nozzles.

The liquid which is ejected from the nozzles is stored in the liquid container 100. The liquid container 100 is loaded to the cartridge holder 120 provided at a position which is different from the recording head 200. The ink in the liquid container 100 is supplied to the recording head 200 through a flow flow path 300. The flow flow path 300 can be made as a tube which is formed of a high polymer, for example. The flow flow path 300 causes the liquid flow port 20 of the liquid container 100 and the recording head 200 to communicate with each other. The recording apparatus in which the liquid container is mounted on the cartridge holder 120 which is provided at a position different from the recording head 200 in this manner is referred to as an off-carriage type. As the recording apparatus, there is a so-called on-carriage type in which a recording head and a flow flow path are integrated in a cartridge holder, and a liquid container is mounted on the cartridge holder in which the head is integrated. The invention can also be applied to such an on-carriage-type recording apparatus.

Nozzles are provided for each ink in the recording head 200. Ink in the corresponding cartridge is supplied to each of the nozzles through the flow flow path 300. In addition, according to the embodiment, the recording apparatus 1000 performs printing using four types of ink, however, printing may be performed using ink of five or more types, or three or less types.

The driving mechanism 230 which causes the recording head 200 to reciprocate includes a timing belt, a driving motor for driving the timing belt, or the like.

A region which is referred to as a home position is provided at a position excluding a printing region in which the recording head 200 is moved in the main scanning direction. A maintenance mechanism is mounted on the home position. The maintenance mechanism includes a gap 280 which forms an enclosed region so as to surround ejecting nozzles by being pushed to a face on which the ejecting nozzles are formed (nozzle face) on the base side of the recording head 200, a lift mechanism (not shown) which lifts the gap 280 so as to push the gap to the nozzle face of the recording head 200, and a suction pump (not shown) which makes the enclosed region which is formed when the gap 280 is pushed to the nozzle face of the recording head 200 have a negative pressure, or the like. The maintenance mechanism may configure a part, or all of a discharging device 700 which will be described later.

In the recording apparatus 1000, a sheet feed mechanism (not shown) for feeding a printing sheet, or a controller 240 which controls the entire operation of the recording apparatus 1000 is mounted. The controller 240 includes an interface with an external apparatus, a CPU, a ROM, a RAM, or the like. An operation of causing the recording head 200 to reciprocate, an operation of feeding a printing sheet, an operation of ejecting ink from nozzles, an operation of executing the maintenance so as to normally perform printing, or the like, may be controlled by the controller 240. In addition, the controller 240 may configure a part of, or the entire controller 500 which will be described later.

In addition, here, the recording head 200 is exemplified as a serial-type recording apparatus in which recording is performed while causing the recording head 200 to reciprocate, however, the invention can also be applied to a line-type recording apparatus in which a line-type recording head which does not reciprocate is used. In addition, a method of recording is not particularly limited when it is possible to attach droplets onto a medium by ejecting ink as the droplets from nozzle holes of the recording head. For example, as a method of recording, it is possible to use an electrostatic attraction method, a method in which droplets are ejected using a pump pressure, a method in which a piezoelectric element is used, a method in which droplets are ejected by heating and foaming liquid using a microelectrode, and the like.

The ink jet recording apparatus can appropriately include a housing of the apparatus, a carriage mechanism of a recording head, a roller, various drivers, various controllers, sensors, a medium transport mechanism, a tray, an operation panel, or the like, in addition to the recording head.

2.2. Gas Discharging Device and Method of Discharging Gas

The recording apparatus 1000 according to the embodiment includes an information obtaining device which obtains information, a discharging device which discharges gases which are generated from liquid, and controller which controls the discharging device according to information which is obtained by the information obtaining device.

Figure 4:
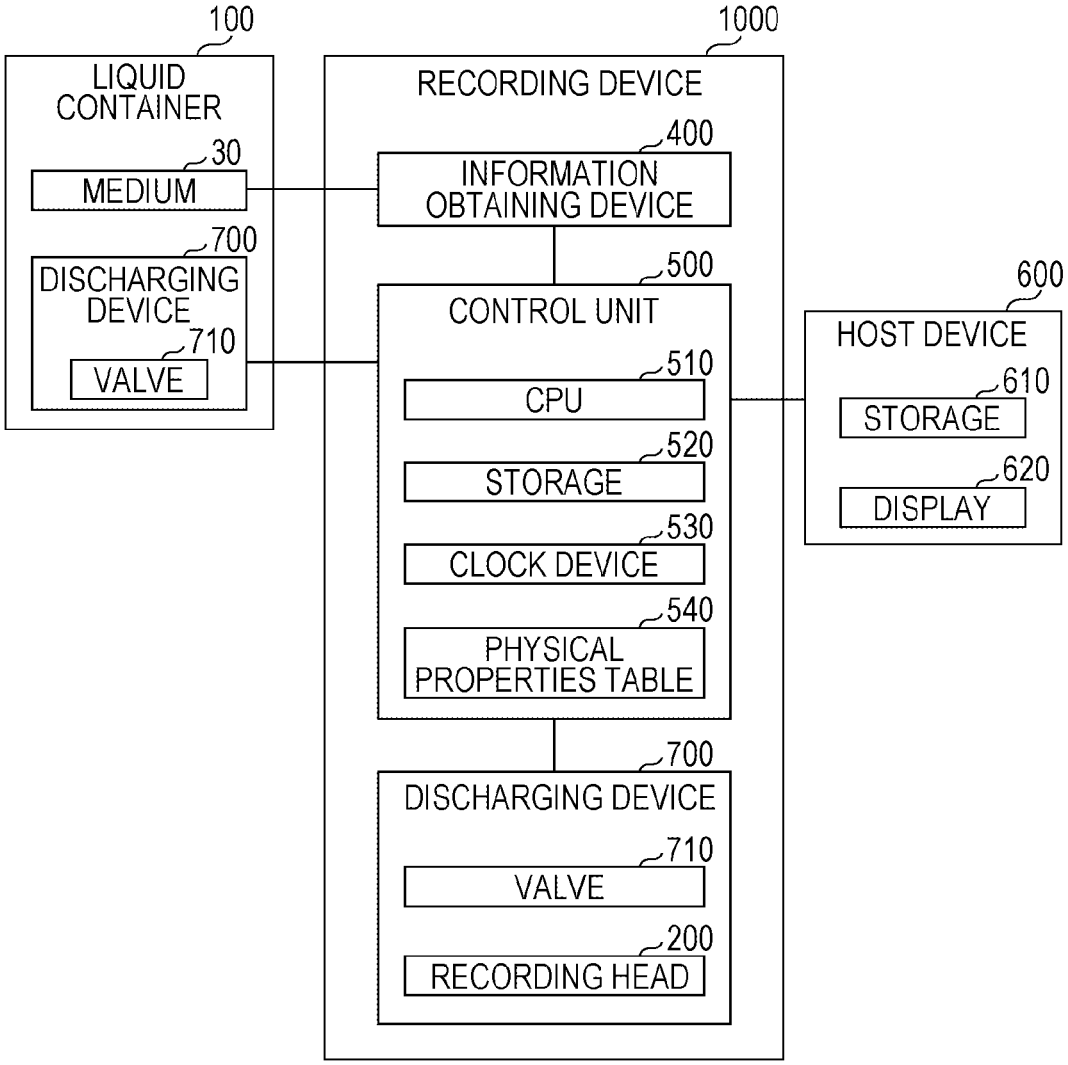
FIG. 4 is an example of a functional block diagram including the recording apparatus according to the embodiment.

FIG. 4 is a diagram which illustrates an example of a functional block including the recording apparatus 1000.

The recording apparatus 1000 includes an information obtaining device 400. The information obtaining device 400 obtains information which is holded in the medium from the medium 30 which is provided in the liquid container 100. As the information obtaining device 400, for example, there is a barcode reader, a CCD camera, an RFID reader, or the like. The information obtaining device 400 may include an IC, or the like, which can appropriately perform arithmetic processing, or generate clock information. The information obtaining device 400 may obtain information which is recorded in the medium 30 from a host device 600, the operation button 130, or the like, through an input of a user. Information which is obtained by the information obtaining device 400 is sent out to a controller 500.

The recording apparatus 1000 includes a discharging device 700 and the controller 500. The discharging device 700 is controlled by the controller 500. It is possible to use the recording head 200 as the discharging device 700. When the recording head 200 is used as the discharging device 700, it is possible to discharge liquid or gases (bubbles) in the liquid container 100 to the outside through the liquid flow port 20 (FIG. 1), the flow flow path 300, and the recording head 200. As a method of discharging gases using the recording head 200, for example, there is a so-called cleaning operation in which suction is performed so that liquid in the flow flow path 300 or the recording head 200 is forcibly discharged to the outside using a suction pump which is not shown, by attaching the gap 280 to the recording head 200. In addition, when there is no need of a discharging force such as the cleaning operation, a flushing operation in which liquid is discharged from the recording head 200 may be performed without attaching the gap 280.

In both cases, it is possible to discharge gases in the liquid container 100, or the flow flow path 300 to the outside along with liquid. Instead of using the recording head 200, a valve 710 of which a control of opening and closing is possible, and is provided at an arbitrary position in the flow flow path 300 may be provided as the discharging device 700, and opening and closing of the valve 710 may be controlled using the controller 500. The valve 710 may be provided in the liquid container 100. For example, as described in <1.5. Other configurations>, the valve 710 may be provided in the liquid container 100 as an open valve which discharges gases which are generated from a liquid to the outside, and opening and closing of the valve 710 may be controlled by the controller 500 of the recording apparatus 1000. The type of the valve 710 is not particularly limited, however, there is an electromagnetic valve, for example. It is possible to discharge gases which are generated in the liquid container 100 to the outside using the discharging device 700 in any of the above described forms.

The controller 500 can be set to the above described controller 240, for example. The controller 500 can be executed using, for example, a CPU 510 and a program. The controller 500 can obtain information from the information obtaining device 400. The controller 500 may include a storage 520 which stores received information. The controller 500 may include a clock device 530 which generates clock information such as current time, or the like. In addition, the controller 500 may obtain information relating to current time, or the like, from the host device 600, or the like. In addition, the controller 500 may include a physical properties table 540 which can be referred to according to a type of liquid which is stored in the liquid container 100. As the physical properties table, there is a table which denotes a relationship between the amount of gases which are generated in a liquid and elapsed time, a threshold value (time, or the like) table corresponding to a type of liquid, or the like.

Figures 5A, 5B, 5C:
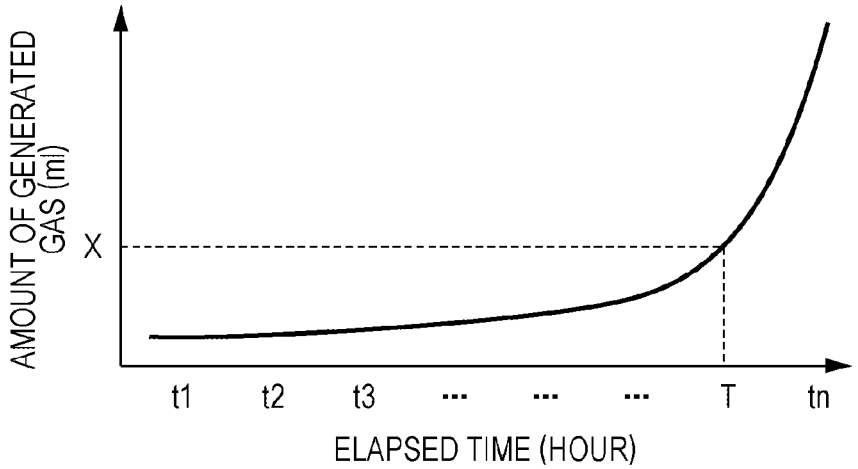
FIG. 5A is a graph which illustrates a relationship between the amount of gases which are generated in a liquid and an elapsed time.
FIG. 5B is an example of a table denoting the relationship between the amount of the gases which are generated in the liquid and the elapsed time.
FIG. 5C is an example of a table denoting a threshold value (time) according to a type of the liquid.

Specific examples of the physical properties table will be described using FIGS. 5A to 5C. FIG. 5A is a graph which denotes a relationship between the amount of gases which are generated in a liquid and elapsed time. FIG. 5B is an example of a table which denotes a relationship between the amount of gases which are generated in a liquid and elapsed time, and FIG. 5C is an example of a threshold value (time) table corresponding to a type of liquid.

As illustrated in FIG. 5A, the liquid (ink) which is stored in the liquid storage chamber 10 generates gases over time due to a chemical change in components. In FIG. 5A, a plurality of samples of ink A of which components are the same are prepared, a relationship between elapsed time and the amount of generated gas is examined, and mean values of results of these samples are made into a graph.

By obtaining the amounts of generated gas a1, a2, a3, . . . , an in elapsed times t1, t2, t3, . . . , to from a profile in FIG. 5A, it is possible to create a physical properties table which denotes a relationship between the amount of gases which are generated in a liquid and elapsed time regarding the ink A, as illustrated in FIG. 5B. In FIG. 5A, only the profile of the ink A is illustrated, however, the profile is different depending on a type of ink. It is possible to create a physical properties table which denotes a relationship between the amount of gases which are generated in a liquid and elapsed time for each type of ink, by creating the profile in FIG. 5A for each type of ink B, C, D, . . . , and by obtaining the amounts of generated gas b1 to bn, c1 to cn, d1 to dn, . . . in elapsed times t1, t2, t3, . . . , tn.

It is possible to create a threshold values (time) table of Ta, Tb, Tc, Td . . . corresponding to the types of ink A, B, C, D, . . . as illustrated in FIG. 5C, by creating the profile in FIG. 5A for each type of ink using the same method, and by obtaining elapsed time T which reaches a threshold value X of the amount of generated gas for each type of ink.

The controller 500 can control the discharging device 700 based on information which is obtained from the information obtaining device 400. The controller 500 may generate signals relating to an availability of liquid, an operation or a stop of the recording apparatus 1000, and the like, in addition to the control of the discharging device 700. The controller 500 may perform a control of the recording apparatus 1000, in addition to the control of the discharging device 700. In addition, the controller 500 may be arranged in the host device 600.

For example, when the result is that a certain period of time has passed from manufacturing of the liquid container based on information which is obtained from the information obtaining device 400, a determination that the liquid cannot be used (not possible to use liquid) may be made, and the recording apparatus 1000 may not be operated. By determining whether or not a liquid can be used, it is possible to prevent deteriorated liquid from being supplied to a recording apparatus. Accordingly, it is possible to suppress an unstable ejecting operation of liquid, or to prevent a quality of an image which is formed by a recording apparatus from deteriorating.

The host device 600 is, for example, a personal computer, and a personal digital assistance (PDA), receives information (signal) which is sent out from the information obtaining device 400, or information input from a user, and performs arithmetic processing based on the information. The host device 600 may control the recording apparatus 1000. For example, the host device 600 may control recording (drawing) which is performed by the recording apparatus 1000. In this case, the host device 600 may further include a storage 610.

The storage 610 is, for example, a semiconductor memory, a hard disk drive, or the like, and may be integrally configured with the host device 600. Information which is stored in the storage 610 is sent out to a display 620, for example.

The display 620 is configured of a display board (liquid crystal monitor, or the like), a luminous body, a speaker, or the like, for example. The display 620 may be designed so as to display or issue time information, or the like, which is obtained by the information obtaining device 400 so that a user can recognize contents thereof.

2.3. Control Processing of Gas Discharging Device

Subsequently, an example of control processing of a gas discharging device in the recording apparatus 1000 according to the embodiment will be described, while referring to the flowchart in FIG. 6.

First, the recording apparatus 1000 detects whether or not the liquid container 100 is mounted on the recording apparatus 1000 using a detector (not shown) at a predetermined timing (step S10). The predetermined timing will be exemplified in detail later, however, the timing means a time when power is input to the recording apparatus 1000, a time when the liquid container 100 is attached or detached in a state in which the power is input, or the like, for example. When the detector (not shown) detects that the liquid container 100 is not mounted on the recording apparatus 1000 (No in step S10), the recording apparatus 1000 performs an error display with respect to a display (not shown) which is provided in the recording apparatus 1000, the display 620 of the host device 600, or the like. When the detector (not shown) detects that the liquid container 100 is mounted on the recording apparatus 1000 (Yes in step S10), the information obtaining device 400 obtains information from the medium 30 which is attached to the mounted liquid container 100 (step S20). According to the embodiment, as described above, the medium 30 holds time information relating to manufacturing of the liquid container 100, and information on a type of liquid (ink) which is stored in the liquid container 100. The information obtaining device 400 obtains these pieces of information from the medium 30. Subsequently, the controller 500 receives the information from the information obtaining device 400, and calculates an elapsed time from a specified point of time based on the information (step S30). The information and the specified point of time are described in <1.4. Time information related to manufacturing of liquid container 100>, for example.

Subsequently, the controller 500 performs processing of determining whether or not it is necessary to discharge gases using the discharging device 700 by referring to the physical properties table 540 which is exemplified in FIG. 5B or 5C (step S40). For example, when the physical properties table which is illustrated in FIG. 5B is used, whether or not the amount of generated gas exceeds a predetermined threshold value X ml is determined by obtaining the amount of generated gas from the physical properties table based on the type of ink which is obtained from the medium 30 in step S20, and the elapsed time which is calculated in step S30. When the physical properties table which is illustrated in FIG. 5C is used, whether or not the elapsed time exceeds the predetermined threshold value T is determined by collating the type of ink which is obtained from the medium 30 in step S20 with the elapsed time which is calculated in step S30 in the physical properties table. When it is necessary to discharge gases based on a result of the determination (Yes in step S40), the controller 500 causes the discharging device 700 to operate, and to discharge the gases (step S50). In addition, the controller 500 waits for a command such as printing, or the like, from the host device 600 after the discharging of the gases (step S60), and ends the process. On the other hand, when it is not necessary to discharge the gases based on the result of the determination (No in step S40), the controller 500 waits for the command such as printing, or the like, from the host device 600 (step S60) without causing the gases to be discharged, and ends the process.

The above described processes can be executed according to the program which is holded in the CPU of the recording apparatus 1000 at the following timings, for example.

When power is input to the recording apparatus 1000.

When the liquid container 100 is attached or detached in a state in which the power is input.

Before starting a recording operation by receiving a start command of recording from the host device 600.

When time information on manufacturing of the liquid container 100 is input to the host device 600 and the recording apparatus 1000.

When a command of maintenance is input to the host device 600 and the recording apparatus 1000.

In addition, the above described processes may be executed every time a predetermined time has passed after inputting power to the recording apparatus 1000. In this case, a program which causes the above described processes to be executed every time the predetermined time has passed after inputting power to the recording apparatus 1000 may be stored in the controller 500.

2.4. Operational Effect of Recording Apparatus 1000

According to the embodiment, the recording apparatus 1000 ascertains the amount of gas which is stored in the liquid container 100 by obtaining the time information on the manufacturing of the liquid container 100 from the liquid container 100, and can appropriately control discharging of the gas. That is, it is possible to adjust a timing of discharging the gas, a method of discharging the gas, the extent of discharging the gas, or the like, in a liquid ejecting apparatus.

In this manner, it is possible to discharge gases of an appropriate amount from the discharging device 700, and to suppress waste of liquid, or incomplete removing of the gas when removing the gas. In addition, it is possible to stably eject liquid to a recording medium by appropriately eliminating gases in a liquid.

3. Modification Examples

3.1. Modification Example 1

When the discharging device 700 is caused to operate and discharge gases (step S50 in FIG. 6), the amount of gas to be discharged may be controlled by the controller 500. The control of the amount of gas to be discharged can be executed by changing operations of the discharging device 700 according to the amount of gas which is obtained by the controller 500 in step S40 in FIG. 6. For example, when discharging of the gas is performed using the recording head 200, a flushing operation may be performed if the amount of gas is smaller than a predetermined amount, and a cleaning operation may be performed if the amount is larger than the predetermined amount. Alternatively, a magnitude of a negative pressure when performing the cleaning operation may be changed according to the amount of gas. When discharging of the gas is performed using the valve 710, the time length of opening the valve may be changed according to the amount of gas.

3.2. Modification Example 2

When determining that it is necessary to discharge the gas (Yes in step S40 in FIG. 6), the controller 500 may inform a user about the fact that it is not possible to use the liquid. As a method of informing, for example, there is displaying of information using characters on the display (not shown) which is provided in the recording apparatus 1000, or on the display 620 of the host device 600, blinking of the luminous body which is provided in the recording apparatus 1000, or the like. In addition, the informing may be performed using a method other than the visual method. For example, the informing may be performed by sounding an alarm using a speaker which is provided in the recording apparatus 1000, and the host device 600, or by performing a sound guide.

3.3. Modification Example 3

Figure 6:
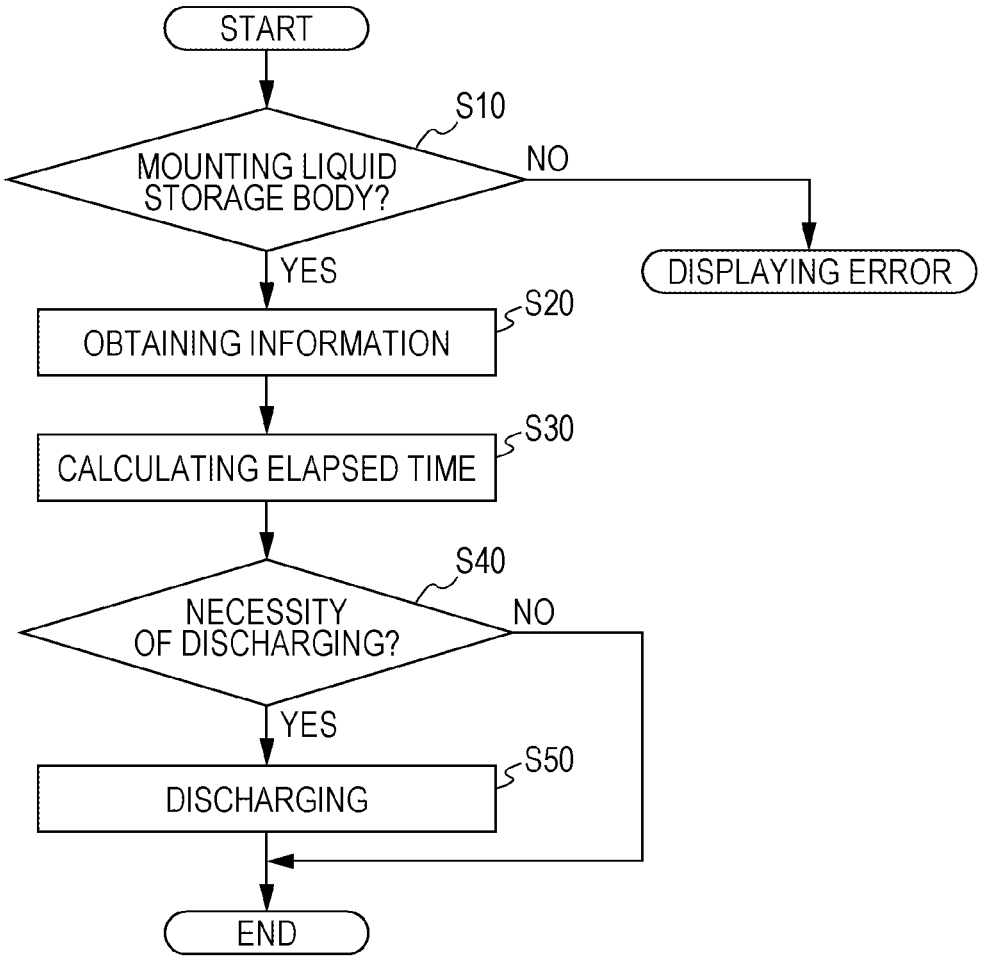
FIG. 6 is an example of a flowchart which illustrates control processing of a gas discharging device according to the embodiment.

There is a case in which it is not possible to normally obtain information by the information obtaining device 400, or there is abnormality in the information which is obtained by the information obtaining device 400 when the controller 500 obtains information in step S20 in FIG. 6. For example, there are when the medium 30 is not provided in the liquid container 100, when information is not recorded in the medium 30, when the information in the medium 30 cannot be obtained by the information obtaining device 400, when some kind of incorrect information is obtained by the information obtaining device 400, when information of "running out of ink" is included in the information which is obtained by the information obtaining device 400, and the like. In such a case, the controller 500 may inform a user about the fact that it is not possible to use liquid or the recording apparatus 1000. As a method of informing, it is possible to adopt the above described visual method, or an auditory method using sound.

3.4. Modification Example 4

When the controller 500 determines that it is necessary to discharge the gas in step S40 in FIG. 6 (Yes in step S40), and performs discharging of the gas (step S50), a user may be informed that the apparatus is under maintenance. As a method of informing, it is possible to adopt the above described visual method, or the auditory method using sound.

3.5. Modification Example 5

When the medium 30 is a readable/writable medium, the recording apparatus 1000 may write various pieces of information on the medium 30 as follows, for example.

3.5.1. Modification Example 5-1

The recording apparatus 1000 may write a date and/or a time (hereinafter, referred to as "date, or the like") when gases are discharged (step S50 in FIG. 6) in the medium 30. When gases are discharged (step S50 in FIG. 6), the recording apparatus 1000 may write the date, or the like, when the gas is discharged in the medium 30. In addition, when performing control processing of the gas discharging device in the next time (flow in FIG. 6), an elapsed time after discharging the gases in the previous time is calculated using the information, and when the elapsed time is remarkably short, discharging of gases may be omitted.

Figure 7:
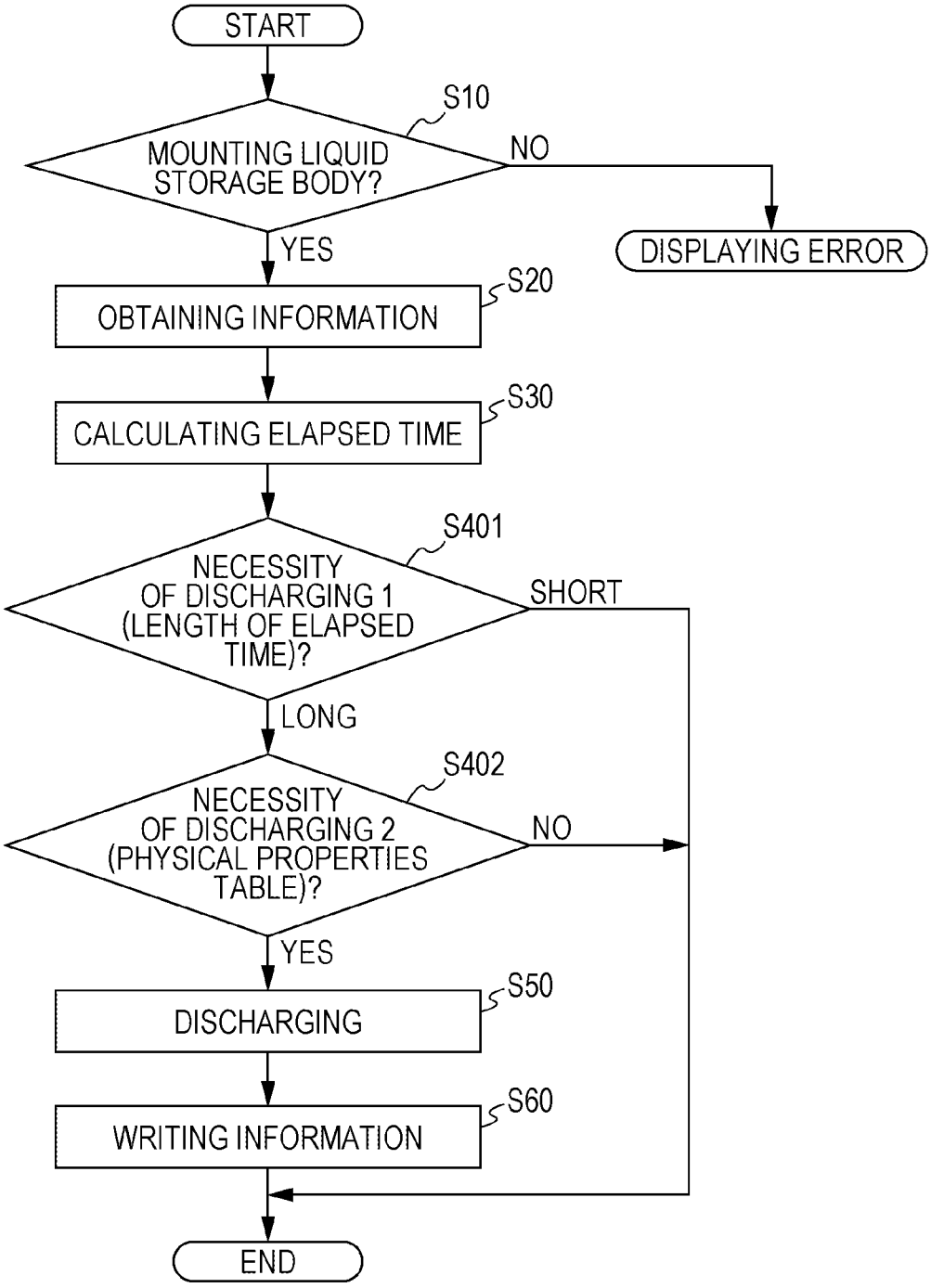
FIG. 7 is a flowchart which illustrates a modification example of control processing of the gas discharging device.

The Modification Example will be described in detail using FIG. 7. FIG. 7 is a flowchart which describes a modification example in control processing. In FIG. 7, the same processing as that in the control processing which is described in FIG. 6 will be given the same mark in FIG. 6, and detailed descriptions thereof will be omitted. The flowchart in FIG. 7 is different from the flowchart in FIG. 6 in that a necessity of discharging is measured in two stages (steps S401 and S402). In addition, the flowchart in FIG. 7 is different from the flowchart in FIG. 6 in that information is written (step S60) after discharging gases (step S50).

As described in FIG. 7, the recording apparatus 1000 performs discharging of gases (step S50), and then writes a date, or the like, thereof in the medium 30 (step S60). FIG. 7 describes an example in which writing of information in the medium 30 is performed after discharging the gases (step S50), however, the writing of information in the medium 30 may be performed before the discharging process (step S50) after the determination in step S40. The recording apparatus 1000 obtains information on the date, or the like, when discharging of gases is performed, which is written in the medium 30 in step S20, when performing control processing of the gas discharging device next time, and calculates an elapsed time from the date in step S30.

Subsequently, whether the elapsed time which is calculated in step S30 is longer or shorter than a predetermined time is determined (step S401). As a result, when the elapsed time is shorter than the predetermined time (Short in step S401), it is determined that discharging in step S401 is not necessary (No in step S401 in FIG. 7). When the elapsed time is longer than the predetermined time (Long in step S401), similarly to step S40 in FIG. 6, necessity of discharging is determined based on the physical properties table.

As a result, when discharging of gases (step S50) is performed, the recording apparatus 1000 writes the date, or the like, in the medium 30 (step S60).

3.5.2. Modification Example 5-2

The recording apparatus 1000 may write a state of consuming of liquid in the liquid container 100 in the medium 30. For example, a value in which an amount of liquid which is used in a recording operation is subtracted from an amount of liquid before performing the recording operation may be written in the medium 30, every time the recording apparatus 1000 performs the recording operation, by recording the amount of liquid before performing the recording operation by the recording apparatus 1000 in the medium 30. In addition, when a sensor for detecting whether or not liquid of a predetermined amount is left in the liquid container 100 is provided in the liquid container 100, a result which is detected by the sensor (a result of, for example, sufficient liquid is left, not much liquid is left, there is no liquid, or the like) may be written in the medium 30. By ascertaining a state of consuming liquid in the liquid container 100 in this manner, it is possible to prevent the recording apparatus 1000 from performing a printing operation in a state in which liquid is not sufficiently supplied to the recording head 200.

3.5.3. Modification Example 5-3

The recording apparatus 1000 may write a use time of the liquid container 100 in the medium 30. In general, an expiration date is provided for a liquid in the liquid container 100. In particular, since a liquid which generates gases due to a chemical change in components is used in the invention, when the expiry date is passed, there is a possibility that a recording quality could be remarkably deteriorated due to a change in property of the liquid, or the recording head 200 could be broken. Therefore, it is preferable to manage a use time of the liquid container 100 using a method in which the use time of the liquid container 100 is updated, and is written in the medium 30 at a predetermined timing, or the like. By managing the use time of the liquid container 100, it is possible to cause the recording apparatus 1000 not to perform the printing operation when the expiry date of the liquid container 100 is passed.

3.6. Modification Example 6

The invention can also be applied to an arbitrary liquid ejecting apparatus which ejects a liquid other than ink, and a liquid container thereof without being limited to the ink jet recording apparatus and the ink cartridge. In addition, here, the "liquid" may be a material which can be ejected by a liquid ejecting apparatus. For example, the "liquid" may be a material of which a substance is in a state of a liquid phase, and a material in a state of a liquid of which viscosity is high or low, a sol, an aqueous gel, and an inorganic solvent, an organic solvent, liquid, a liquid resin, and a liquid metal (metallic melt) other than that are also included in the "liquid". In addition, a material in which particles of a functional material which is formed of a solid body such as pigment, or metal particles are dissolved, dispersed, or mixed into a solvent is also included in the "liquid", not only a liquid as one state of a substance. As a representative example of the liquid, there is the above described ink. The ink includes various liquid compositions such as water based ink, oil based ink, gel ink, hot melt ink, or the like.

3.7. Others

The invention is not limited to the above described embodiment, and can be variously modified. For example, the invention includes practically the same configuration (for example, configuration of which function, method, and result are the same, or configuration of which object and effect are the same) as the configuration which is described in the embodiment. In addition, the invention includes a configuration in which a portion which is not essential in the configuration which is described in the embodiment is replaced. In addition, the invention includes a configuration which shows the same operational effect, or a configuration which can achieve the same object as the configuration which is described in the embodiment. In addition, the invention includes a configuration in which a known technology is added to the configuration which is described in the embodiment.

The entire disclosure of Japanese Patent Application No. 2013-034391, filed Feb. 25, 2013 and 2013-262137, filed Dec. 19, 2013 are expressly incorporated by reference herein.

What is claimed is:

1. A liquid ejecting apparatus comprising:

a liquid container including:

a liquid which generates gases over time due to a chemical change in components;

a liquid storage chamber in which the liquid is stored;

a liquid flow port which communicates with the liquid storage chamber, via which the liquid inside the liquid storage chamber flows out; and an information holding portion which holds time information on manufacturing of the liquid container;

a cartridge holder on which the liquid container is mounted;

a head which ejects liquid which is supplied from the liquid container;

a flow path which causes a liquid flow port of the liquid container and the head to communicate with each other;

an information obtaining device which obtains time information;

a discharging device which discharges gases; and a controller which controls the discharging device according to the time information which is obtained by the information obtaining device.

2. The liquid ejecting apparatus according to claim 1, wherein at least one of the components is a base metal pigment.

3. The liquid ejecting apparatus according to claim 2, wherein the base metal pigment is coated using a protective film, and is contained with a concentration of 5% by mass or less with respect to a total amount of the liquid.

4. The liquid ejecting apparatus according to claim 1, wherein the time information includes at least one piece of information among the following pieces of information of (1) to (4):

(1) a date and/or a time based on an activity of manufacturing the liquid, or components thereof, (2) a date and/or a time based on an activity of storing the liquid in the liquid container, (3) an elapsed period from a date and/or a time based on the activity of manufacturing the liquid, or the components thereof, and (4) an elapsed period from a date and/or a time based on the activity of storing the liquid in the liquid container.

5. The liquid ejecting apparatus according to claim 1, wherein the liquid container is not open to ambient air.

6. The liquid ejecting apparatus according to claim 1, wherein the liquid flow port is provided at a position which is an upper side with respect to a center in a vertical direction of the liquid container.

7. The liquid ejecting apparatus according to claim 1, wherein the controller determines whether or not the contoller is possible to use the liquid based on the time information.

8. The liquid ejecting apparatus according to claim 1, wherein the liquid container is mounted on the cartridge holder by being inclined to a level surface so that the liquid flow port is located on a side which is far from the level surface.

* * * * *